US007988491B2

(12) United States Patent
Davis et al.

(10) Patent No.: US 7,988,491 B2
(45) Date of Patent: Aug. 2, 2011

(54) ELECTRICAL CONNECTOR HAVING CONTACT MODULES

(75) Inventors: Wayne Samuel Davis, Harrisburg, PA (US); Robert Neil Whiteman, Jr., Middletown, PA (US); Dharmendra Saraswat, Harrisburg, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/636,141

(22) Filed: Dec. 11, 2009

(65) Prior Publication Data

US 2011/0143591 A1 Jun. 16, 2011

(51) Int. Cl.
*H01R 13/648* (2006.01)

(52) U.S. Cl. ..... 439/607.27

(58) Field of Classification Search ..... 439/108, 439/607.27

See application file for complete search history.

(56) References Cited

U.S. PATENT DOCUMENTS

| | | | | |
|---|---|---|---|---|
| 6,899,566 | B2 | 5/2005 | Kline et al. | |
| 7,094,102 | B2 * | 8/2006 | Cohen et al. | 439/607.08 |
| 7,267,515 | B2 | 9/2007 | Lappöhn | |
| 7,344,391 | B2 * | 3/2008 | Minich | 439/108 |

* cited by examiner

*Primary Examiner* — Khiem Nguyen

(57) ABSTRACT

A contact module is provided for an electrical connector. The contact module includes a housing having a mating edge, a mounting edge, and a side. An electrical lead is held by the housing. The electrical lead extends from a mating contact to a mounting contact. The mating contact extends outwardly from the mating edge of the housing. The mounting contact extends outwardly from the mounting edge of the housing. An inner ground shield is mounted on the housing. The inner ground shield includes a housing side segment that extends over at least a portion of the side of the housing between the mating and mounting edges thereof. An outer ground shield is mounted on the housing. The outer ground shield extends over at least a portion of the housing side segment of the inner ground shield.

20 Claims, 12 Drawing Sheets

ELECTRICAL CONNECTOR HAVING CONTACT MODULES

BACKGROUND OF THE INVENTION

The subject matter herein relates generally to electrical connectors, and more particularly to electrical connectors having contact modules.

Some electrical systems utilize electrical connectors to interconnect two printed circuits (sometimes referred to as "circuit boards") to one another. In some applications, the printed circuits are oriented orthogonal to one another. To electrically connect the electrical connectors, a midplane printed circuit is provided with front and rear header connectors on opposed front and rear sides of the midplane printed circuit. The midplane printed circuit may be orthogonal to both of the printed circuits being electrically connected. The front header connector receives one of the electrical connector and the rear header connector receives the other electrical connector. The front and rear header connectors each include pins that are connected to corresponding mating contacts of the electrical connectors. The pins of the front header connector are electrically connected to the pins of the rear header connector by the midplane printed circuit. For example, traces are routed along and/or through the midplane printed circuit to electrically connect corresponding pins with one another.

Known electrical systems that interconnect two or more printed circuits through a midplane printed circuit are not without disadvantages. For instance, known electrical systems are prone to signal degradation due to the number of mating interfaces provided between the printed circuits that are being connected. For example, along the signal path from a first printed circuit to the a second printed circuit includes an interface with the first electrical connector, the mating interface between the first electrical connector and the first header connector, an interface between the first header connector and the midplane printed circuit, an interface between the midplane printed circuit and the second header connector, a mating interface between the second header connector and the second electrical connector, and an interface between the second electrical connector and the second printed circuit. Signal degradation may be inherent at each of the interfaces described above. Additionally, some signal degradation is inherent along any portion of the contacts, pins and traces defining the signal path between the two printed circuits. The signal degradation problems may be particularly noticeable at higher signal speeds.

Other problems with known connector systems that utilize a midplane printed circuit include the cost of the midplane printed circuit and the cost of the front and rear header connectors. Thus, the interconnection of printed circuits with minimal signal loss remains a challenge.

BRIEF DESCRIPTION OF THE INVENTION

In one embodiment, a contact module is provided for an electrical connector. The contact module includes a housing having a mating edge, a mounting edge, and a side. An electrical lead is held by the housing. The electrical lead extends from a mating contact to a mounting contact. The mating contact extends outwardly from the mating edge of the housing. The mounting contact extends outwardly from the mounting edge of the housing. An inner ground shield is mounted on the housing. The inner ground shield includes a housing side segment that extends over at least a portion of the side of the housing between the mating and mounting edges thereof. An outer ground shield is mounted on the housing. The outer ground shield extends over at least a portion of the housing side segment of the inner ground shield.

In another embodiment, an electrical connector includes a housing and a contact module held by the housing. The contact module includes a dielectric body having a mating edge, a mounting edge, and a side. An electrical lead is held by the body. The electrical lead extends from a mating contact to a mounting contact. The mating contact extends outwardly from the mating edge of the body. The mounting contact extends outwardly from the mounting edge of the body. An inner ground shield is mounted on the body. The inner ground shield includes a body side segment that extends over at least a portion of the side of the body between the mating and mounting edges thereof. An outer ground shield is mounted on the body. The outer ground shield extends over at least a portion of the body side segment of the inner ground shield.

DETAILED DESCRIPTION OF THE INVENTION

Figure 1:
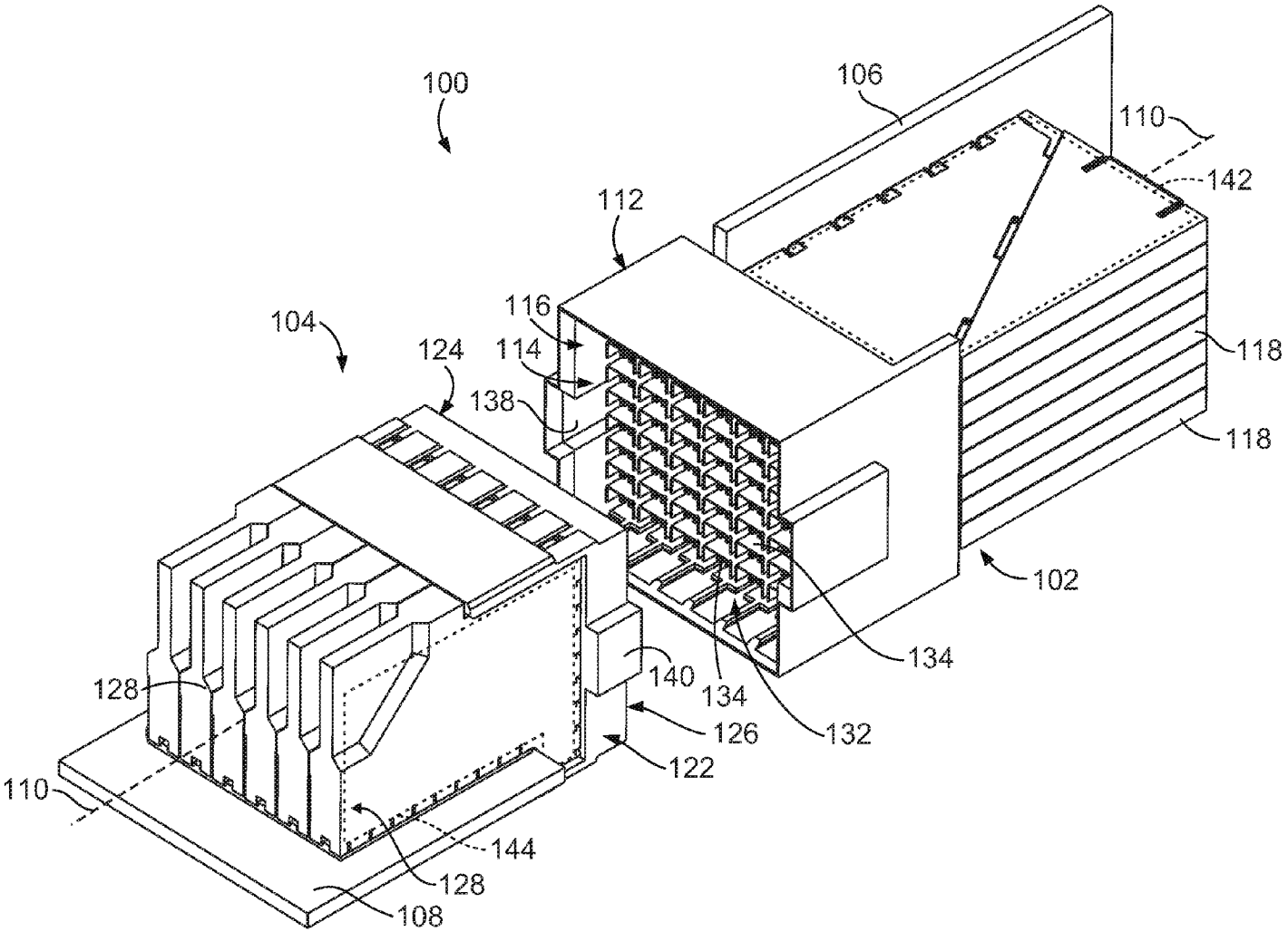
FIG. 1 is a perspective view of an exemplary embodiment of an orthogonal connector system illustrating an exemplary embodiment of a receptacle assembly and an exemplary embodiment of a header assembly in unmated positions.

FIG. 1 is a perspective view of an exemplary embodiment of an orthogonal connector system 100 illustrating two connector assemblies 102 and 104 that may be directly mated together. The connector assemblies 102 and 104 are each electrically connected to a respective printed circuit 106 and 108. The connector assemblies 102 and 104 are utilized to electrically connect the printed circuits 106 and 108 to one another along a separable mating interface. The printed circuits 106 and 108 are orthogonal to one another and the connector assemblies 102 and 104 are orthogonal to one another. For example, the connector assemblies 102 and 104 are turned 90° relative to each other. A mating axis 110 extends through the connector assemblies 102 and 104. The connector assemblies 102 and 104 are mated together in a direction parallel to and along the mating axis 110. In the exemplary embodiment, both the printed circuits 106 and 108 extend approximately parallel to the mating axis 110.

In the exemplary embodiment, the connector assembly 102 constitutes a header assembly, and will be referred to hereinbelow as "header assembly 102". The connector assembly 104 constitutes a receptacle assembly, and will be referred to hereinbelow as "receptacle assembly 104". The header assembly 102 and the receptacle assembly 104 may each be referred to herein as an "electrical connector".

The header assembly 102 includes a housing 112 having a mating face 114 at an end 116 of the housing 112. A plurality of contact modules 118 are held by the housing 112. The contact modules 118 are electrically connected to the printed circuit 106. The mating face 114 is optionally oriented approximately perpendicular to the printed circuit 106 and the mating axis 110. Similar to the header assembly 102, the receptacle assembly 104 includes a housing 122 having a mating face 124 at an end 126 of the housing 122. A plurality of contact modules 128 are held by the housing 122. The contact modules 128 are electrically connected to the printed circuit 108. The mating face 124 is optionally oriented approximately perpendicular to the printed circuit 108 and the mating axis 110.

The housing 112 of the header assembly 102 includes a chamber 132 that receives a portion of the housing 122 of the receptacle assembly 104 therein. An array of mating contacts 134 is arranged within the chamber 132 for mating with corresponding mating contacts 136 (FIG. 11) of the receptacle assembly 104. The mating contacts 134 extend from corresponding contact modules 118 into the chamber 132 when the contact modules 118 are held by the housing 112. The mating contacts 134 are electrically connected to the printed circuit 106 via corresponding electrical leads 188 (FIG. 3) of the contact modules 118.

The housing 112 of the header assembly 102 includes alignment features 138 in the form of grooves that open at the chamber 132. The alignment features 138 are configured to interact with corresponding alignment features 140 on the housing 122 of the receptacle assembly 104. The alignment features 140 on the housing 122 are in the form of outwardly-extending projections. The alignment features 138 and 140 orient and/or guide the receptacle assembly 104 and header assembly 102 in an orthogonal orientation with respect to one another. In addition or alternative to the projections and/or grooves, the alignment features 138 and/or 140 may have different shapes and/or may be a different type. The header and receptacle assemblies 102 and 104, respectively, may each have any number of the respective alignment features 138 and 140.

The contact modules 118 of the header assembly 102 are each arranged along approximately parallel header contact module planes 142, one of which is shown in FIG. 1. Similarly, the contact modules 128 of the receptacle assembly 104 are each arranged along approximately parallel receptacle contact module planes 144, one of which is shown in FIG. 1. The header contact module planes 142 are oriented approximately perpendicular with respect to the receptacle contact module planes 144. The header contact module planes 142 are oriented approximately parallel with respect to the printed circuit 108. The receptacle contact module planes 144 are oriented approximately parallel with respect to the printed circuit 106.

Figure 2:
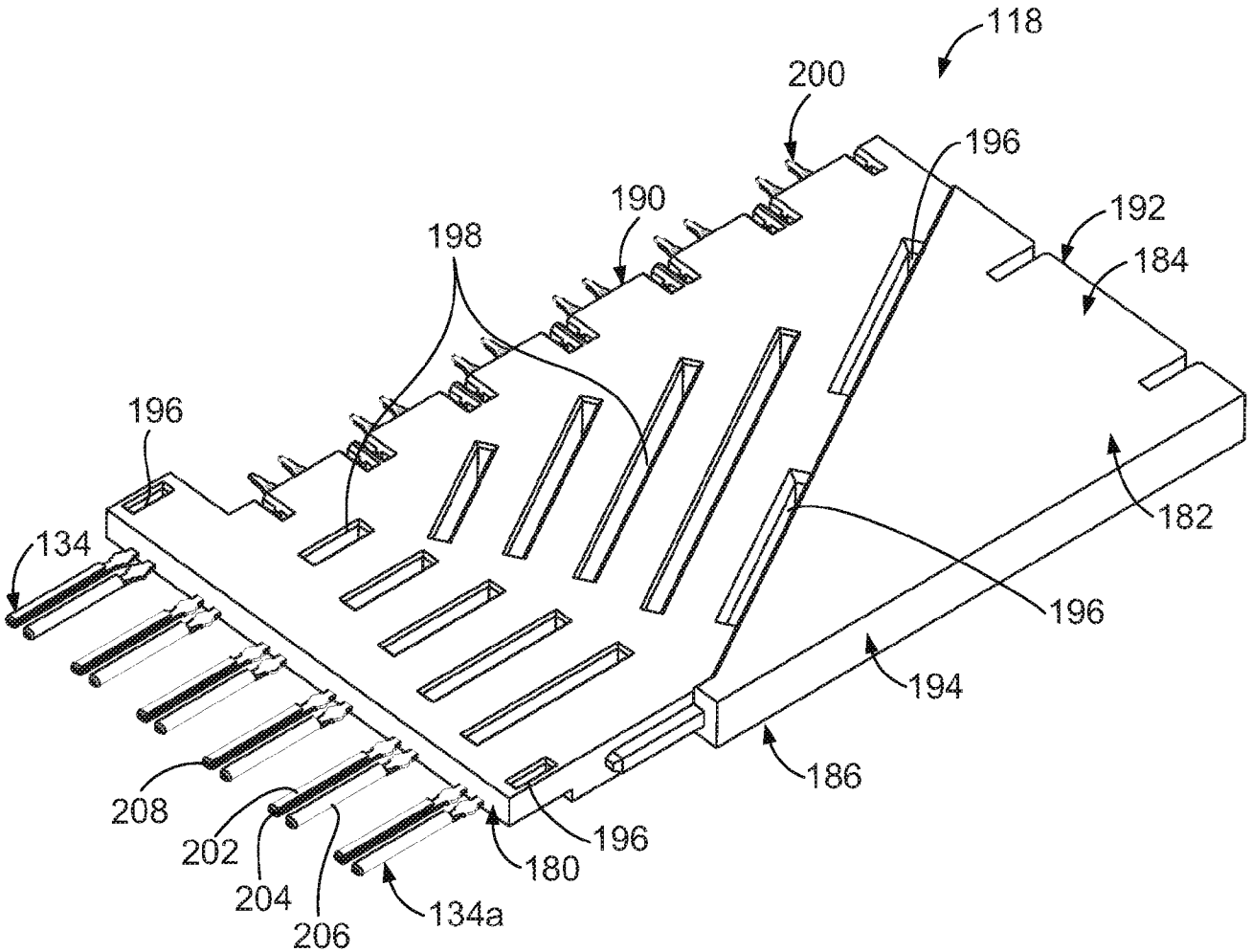
FIG. 2 is a perspective view of an exemplary embodiment of a portion of a contact module of the header assembly shown in FIG. 1.
Figure 10:
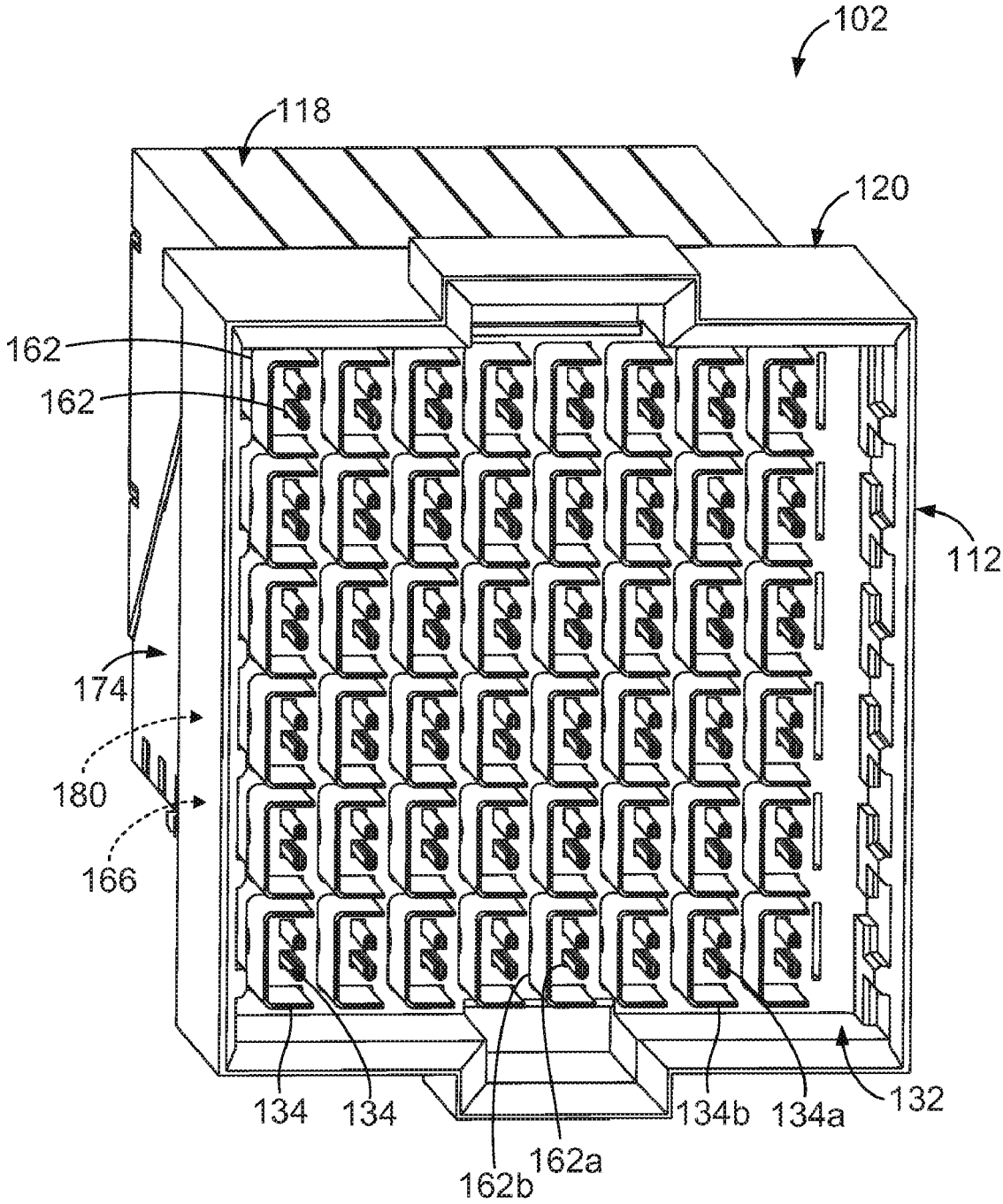
FIG. 10 is a front perspective view of the header assembly shown in FIG. 1.
Figure 12:
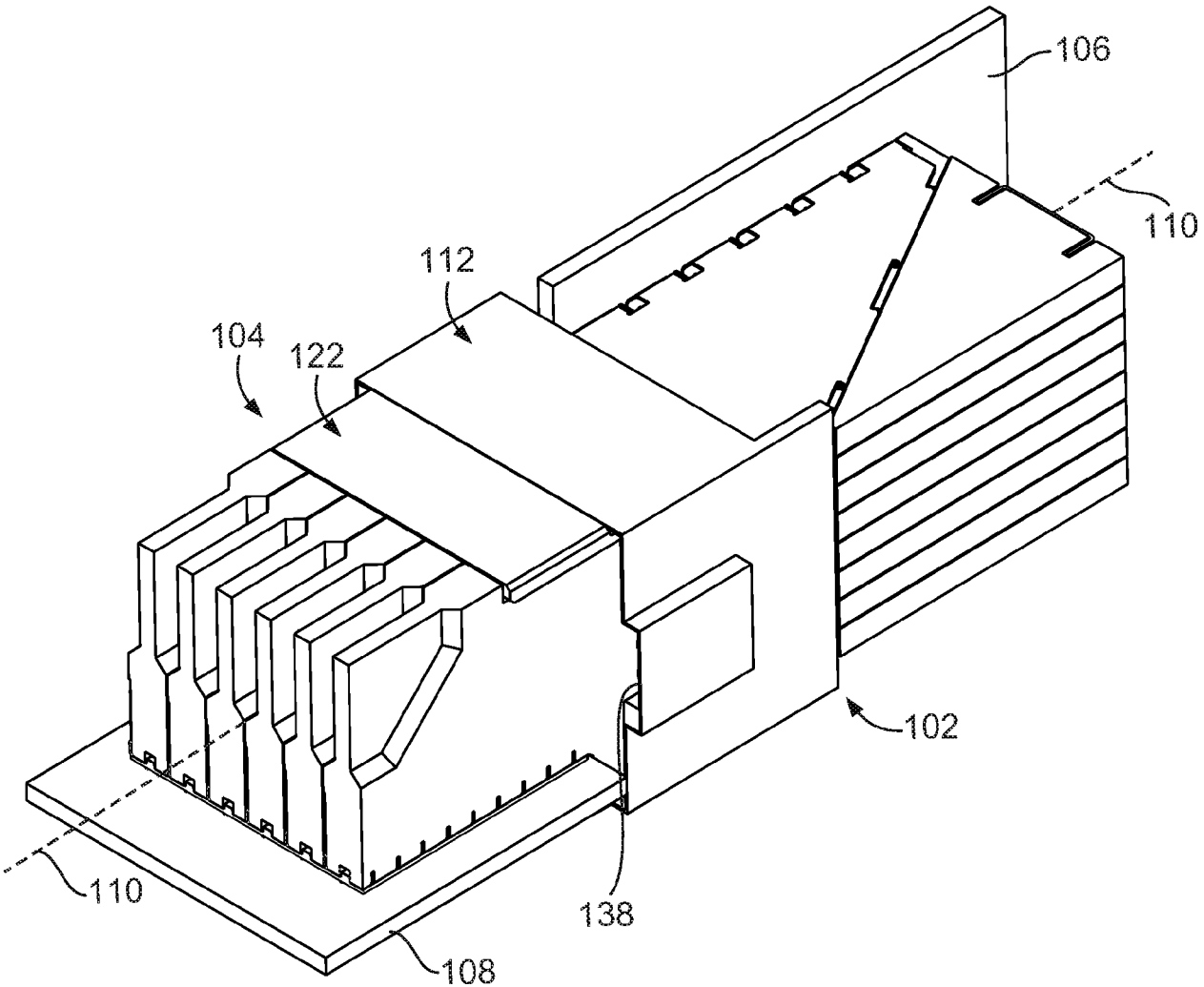
FIG. 12 is a perspective view of the orthogonal connector system shown in FIG. 1 with the receptacle assembly and the header assembly in a mated position.

FIG. 2 is a perspective view of an exemplary embodiment of a portion of one of the contact modules 118 of the header assembly 102 (FIGS. 1, 10, and 12). The contact module 118 includes a dielectric body 182 having opposed sides 184 and 186. The contact module body 182 holds a plurality of the electrical leads 188 therein. The electrical leads 188 are not visible in FIG. 2, but are shown in phantom in FIG. 3. The contact module body 182 includes a mating edge 180 and a mounting edge 190. In the exemplary embodiment, the mating edge 180 is approximately perpendicular to the mounting edge 190. The contact module body 182 also includes a rear edge 192 opposite the mating edge 180 and a top edge 194 opposite the mounting edge 190. Optionally, the body 182 of the contact module 118 includes one or more mounting openings 196 and one or more slots 198. The body 182 of the contact module 118 may be referred to herein as a "housing".

Figure 11:
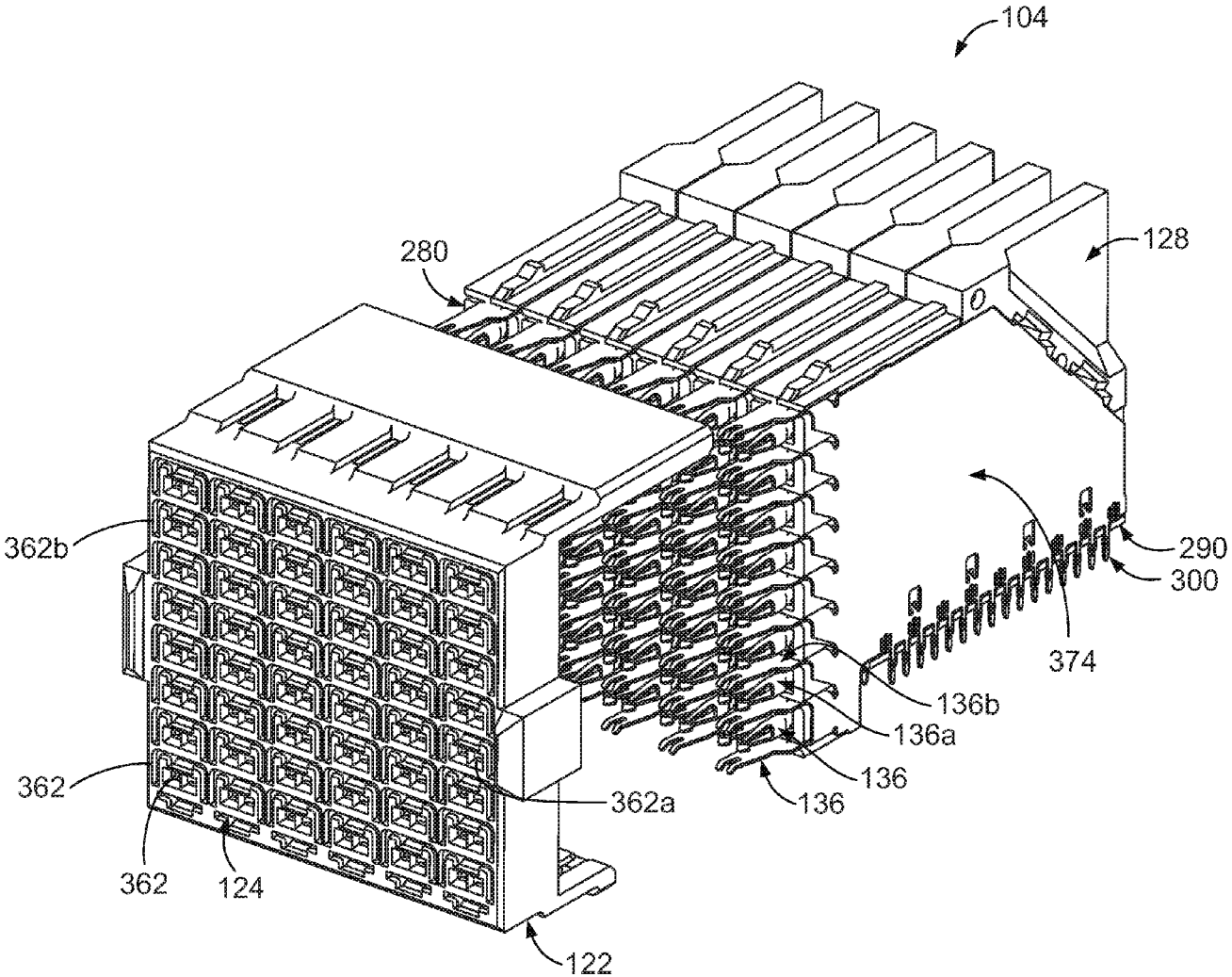
FIG. 11 is a partially exploded perspective view of the receptacle assembly shown in FIG. 1.

The mating contacts 134 of the header assembly 102 include signal contacts **134*a* and ground contacts 134*b* (FIGS. 4-8 and 10). The contact module 118 includes a plurality of the signal contacts 134*a* and a plurality of mounting contacts 200. The signal contacts 134*a* extend outwardly from the mating edge 180 of the contact module body 182. Each signal contact 134*a* includes a pair of opposite sides 202 and 204, and a pair of opposite sides 206 and 208 that extend from, and between, the sides 202 and 204. The signal contacts 134*a* are configured for mating engagement with corresponding signal contacts 136*a* of the mating contacts 136 (FIG. 11) of the receptacle assembly 104 (FIGS. 1, 11, and 12). In the exemplary embodiment, each of the signal contacts 134*a* is configured to carry data signals. But, in addition or alternative, one or more of the signal contacts 134*a* may be a ground contact, a power contact, and/or the like. Some or all of the signal contacts 134*a* are optionally arranged in differential pairs for carrying differential pair signals. Optionally, the signal contacts 134*a* within each differential pair may be positioned closer to one another than to signal contacts 134*a* of another differential pair. Such an arrangement may more closely couple the signal contacts 134*a* within the differential pair to one another than to signal contacts 134*a* of another differential pair. In the exemplary embodiment, the signal contacts 134*a* are rolled pins. But, other types and/or styles of contacts may be provided in alternative embodiments for mating with the corresponding mating contacts 136 of the receptacle assembly 104, such as, but not limited to, tuning fork style contacts and/or the like. Each of the sides 202, 204, 206, and 208 of the signal contacts 134*a*** may be referred to herein as a "first side" and/or a "second side".

The mounting contacts 200 extend outwardly from the mounting edge 190 for engagement with the printed circuit 106 (FIGS. 1 and 12). The engagement between the mounting contacts 200 and the printed circuit 106 electrically connects the mounting contacts 200, and thereby the contact module 118, to the printed circuit 106. In the exemplary embodiment, each of the mounting contacts 200 is configured to carry data signals. But, in addition or alternative, one or more of the mounting contacts 200 may be a ground contact, a power contact, and/or the like. Some or all of the mounting contacts 200 are optionally arranged in differential pairs for carrying differential pair signals. Optionally, the mounting contacts 200 within each differential pair may be positioned closer to one another than to mounting contacts 200 of another differential pair. Such an arrangement may more closely couple the mounting contacts 200 within the differential pair to one another than to mounting contacts 200 of another differential pair. In the exemplary embodiment, the mounting contacts 200 are eye-of-the needle type contacts that fit into vias (not shown) of the printed circuit 106. But, other types and/or styles of contacts may be provided in alternative embodiments for electrical connection to the printed circuit 106, such as, but not limited to, through hole mounting contacts, surface mounting contacts, and/or the like.

Figure 3:
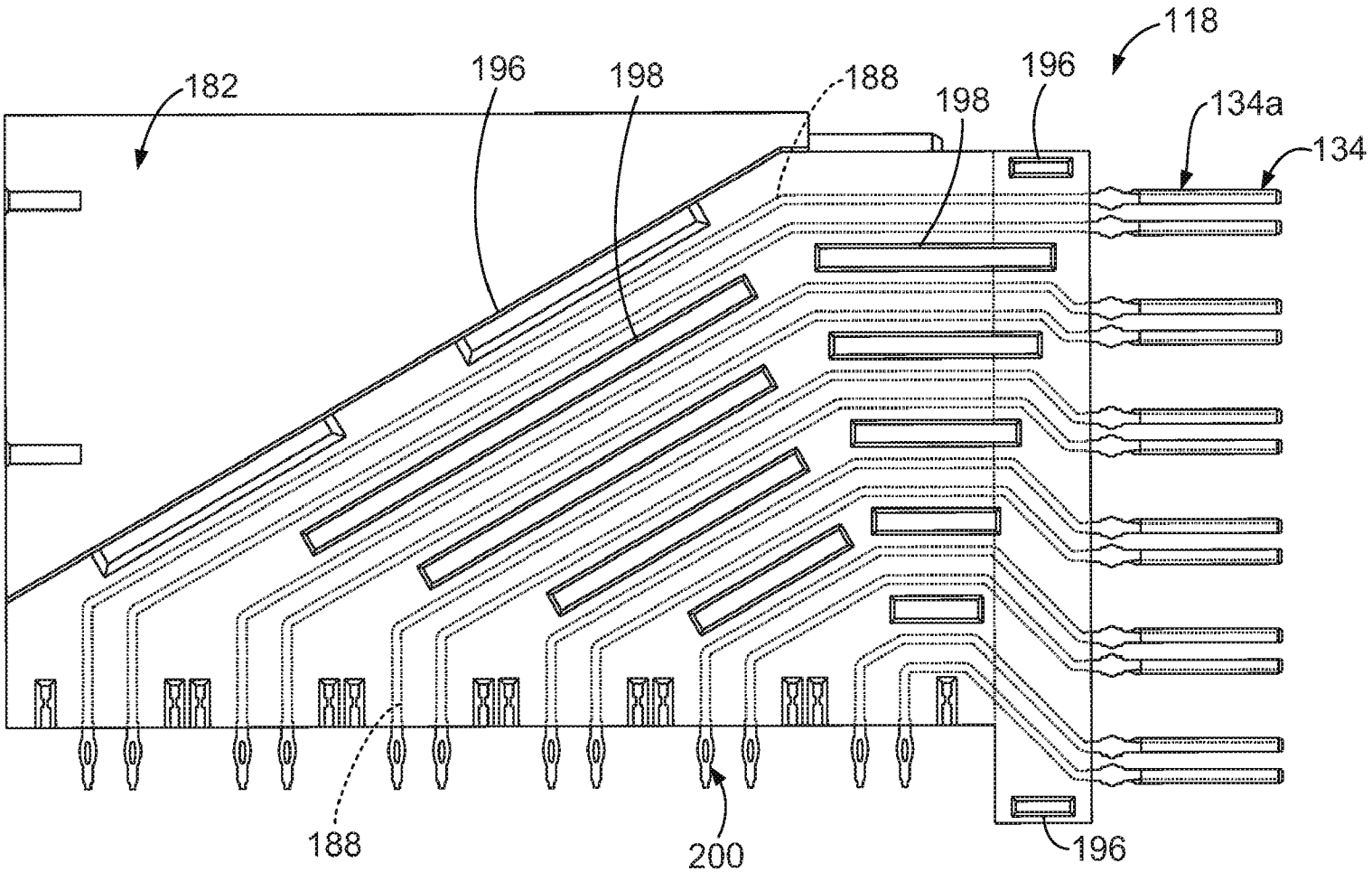
FIG. 3 is a side elevational view of the portion of the contact module shown in FIG. 2.

FIG. 3 is a side elevational view of a portion of the contact module 118. The electrical leads 188 are shown in phantom in FIG. 3. Each electrical lead 188 extends from a corresponding one of the signal contacts 134*a* to a corresponding one of the mounting contacts 200. Each electrical lead 188 thereby electrically connects the corresponding signal contact 134*a* to the corresponding mounting contact 200. As can be seen in FIG. 3, the slots 198 of the contact module body 182 extend between adjacent electrical leads 188. In the exemplary embodiment, the slots 198 extend between adjacent differential pairs of the electrical leads 188. Specifically, the slots 198 extend between an electrical lead 188 of a first differential pair and an electrical lead 188 of a second differential pair that is adjacent the first differential pair.

In the exemplary embodiment, each of the electrical leads 188 is configured to carry data signals between the corresponding signal contact 134*a* and the corresponding mounting contact 200. But, in addition or alternative, one or more of the electrical leads 188 may be a ground lead, a power lead, and/or the like. As described above, some or all of the electrical leads 188 are optionally arranged in differential pairs for carrying differential pair signals. Optionally, the electrical leads 188 within each differential pair may be positioned closer to one another than to electrical leads 188 of another differential pair. Such an arrangement may more closely couple the electrical leads 188 within the differential pair to one another than to other adjacent electrical leads 188 of another differential pair.

In the exemplary embodiment, the electrical leads 188 are formed from a lead frame and the contact module body 182 is overmolded around the electrical leads 188. Alternatively, individual leads representing the electrical leads 188 are positioned within the contact module body 182. Optionally, the signal contacts 134*a* and/or the mounting contacts 200 may be integrally formed with the corresponding electrical lead 188 as part of the lead frame.

Figure 4:
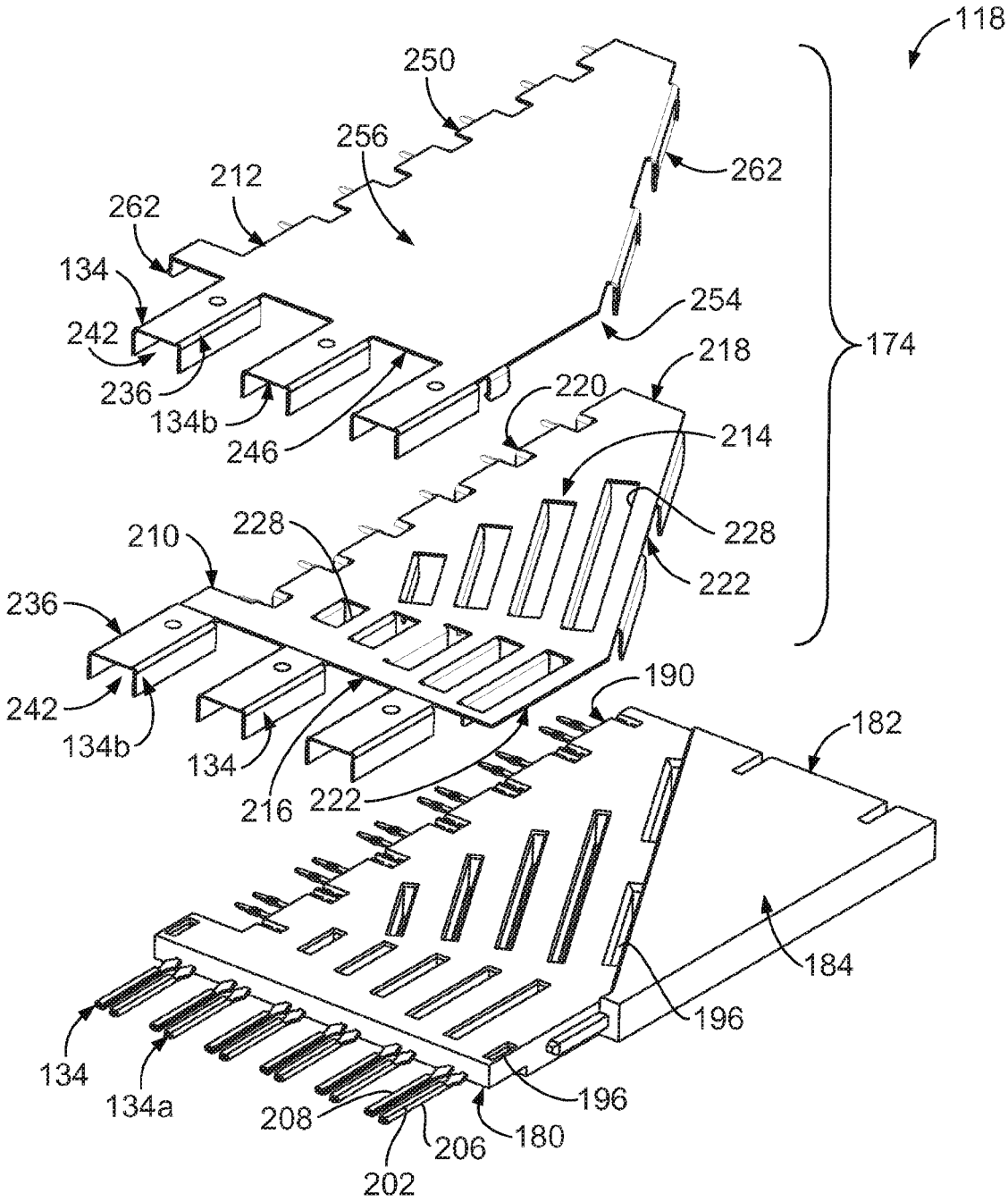
FIG. 4 is an exploded perspective view of the contact module shown in FIGS. 2 and 3 and an exemplary embodiment of a ground shield assembly thereof.

FIG. 4 is an exploded perspective view of the contact module 118 and an exemplary embodiment of a ground shield assembly 174 thereof. At least one of the contact modules 118 of the header assembly 102 (FIGS. 1, 10, and 12) includes a ground shield assembly 174, which is mounted on the body 182 of the contact module 118. Optionally, each of the contact modules 118 includes a ground shield assembly 174. The ground shield assembly 174 includes an inner ground shield 210 and an outer ground shield 212. As will be described in more detail below, the inner ground shield 210 is mounted on the side 184 of the body 182 of the contact module 118. The outer ground shield 212 is mounted on the body 182 of the contact module 118 such that the outer ground shield 212 extends over at least a portion of the inner ground shield 210. The inner and outer ground shields 210 and 212, respectively, each include the ground contacts 134*b* of the mating contacts 134.

Figure 5:
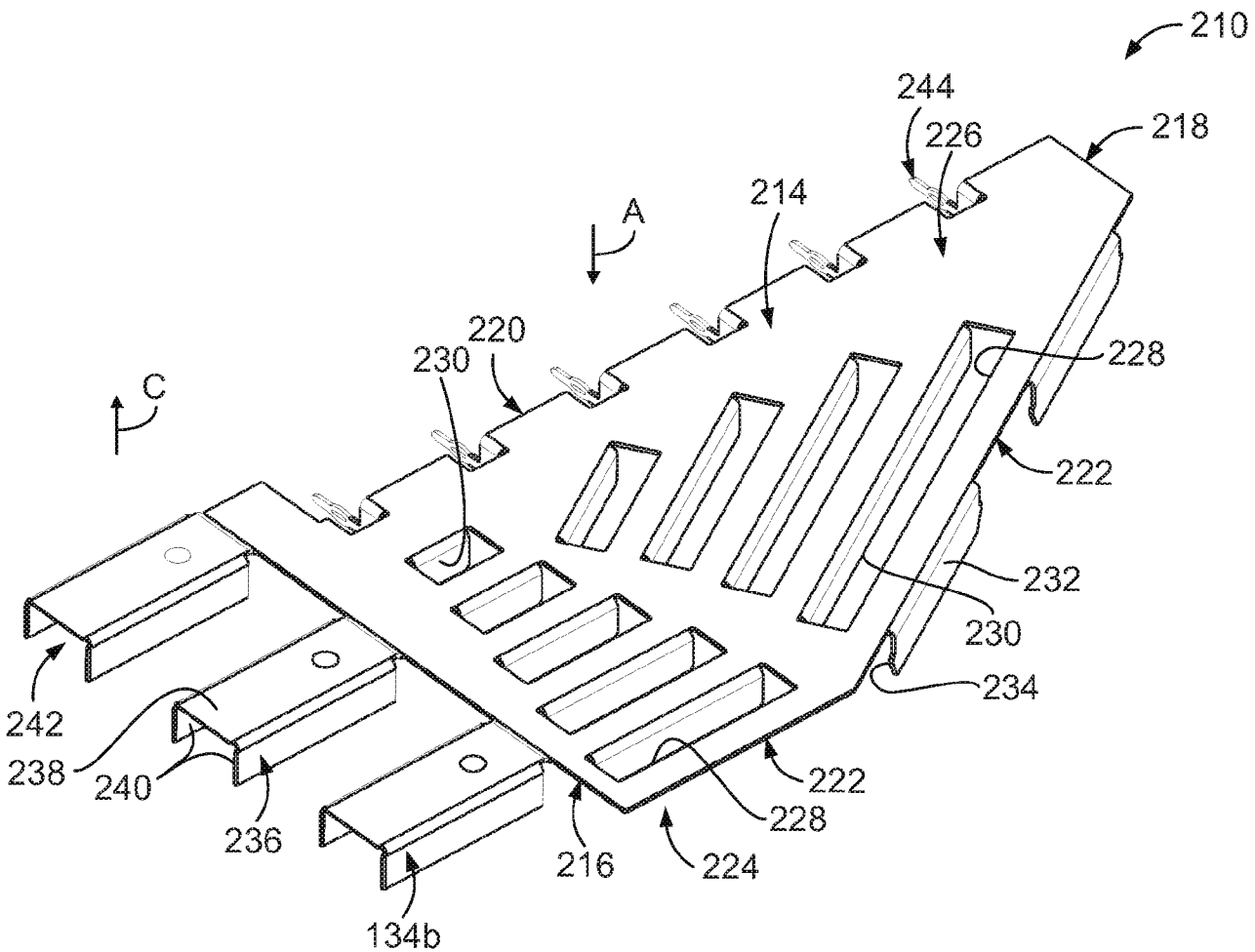
FIG. 5 is a perspective view of an exemplary embodiment of an inner ground shield of the ground shield assembly shown in FIG. 4.

FIG. 5 is a perspective view of an exemplary embodiment of the inner ground shield 210. The inner ground shield 210 includes a housing side segment 214 that extends from a front edge 216 to a rear edge 218 that is opposite the front edge 216. The housing side segment 214 also extends from a circuit edge 220 to an opposite top edge 222. The circuit and top edges 220 and 222, respectively, extend between, and interconnect, the front edge 216 and the rear edge 218. The inner ground shield 210 includes an inner side 224 and an outer side 226 that is opposite the inner side 224. The housing side segment 214 may be referred to herein as a "body side segment".

The housing side segment 214 of the inner ground shield 210 includes a plurality of openings 228 that extend therethrough. Specifically, the openings 228 extend through the inner side 224, the outer side 226, and completely through the housing side segment 214 therebetween. A separator extension 230 extends proximate each opening 228. The separator extensions 230 extend outwardly from the inner side 224 of the inner ground shield 210. Optionally, the separator extensions 230 are stamped from the housing side segment 214 and bent outwardly from the inner side 224 to define the openings 228. Although nine openings 228 and nine separator extensions 230 are shown, the inner ground shield 210 may include any number of the openings 228 and any number of the separator extensions 230, whether or not the number of openings 228 is the same as the number of extensions 230.

A plurality of mounting tabs 232 extend outwardly from the inner side 224 of the inner ground shield 210. The mounting tabs 232 are configured to be received within the mounting openings 196 (FIGS. 2-4, 6, and 8) of the contact module body 182 (FIGS. 2-4, 6, and 8) for mounting the inner ground shield 210 on the contact module body 182. In the exemplary embodiment, the mounting tabs 232 include barbs 234 that are configured to engage the contact module body 182 to connect the inner ground shield 210 to the body 182 using an interference-fit connection. In addition or alternative to the mounting tabs 232 and/or the barbs 234, the inner ground shield 210 may be mounted on the contact module body 182 using any other structure, fastener, connection type, and/or the like, such as, but not limited to, a snap-fit, a latch, a clip, a threaded fastener, and/or the like.

The inner ground shield 210 includes some of the ground contacts 134*b* of the mating contacts 134. The ground contacts 134*b* extend outwardly from the front edge 216 of housing side segment 214. In the exemplary embodiment, the ground contacts 134*b* of the inner ground shield 210 include a u-shaped body 236. Specifically, each ground contact 134*b* of the inner ground shield 210 includes a bottom wall 238 and a pair of opposite side walls 240 that extend outwardly from opposite edges of the bottom wall 238. The walls 238 and 240 define a cavity 242 therebetween. As will be described below, corresponding ones of the signal contacts 134*a* (FIGS. 2-4, 6, 8, and 10) are received within the cavity 242 when the inner ground shield 210 is mounted on the contact module body 182. Optionally, the bottom wall 238 of the grounds contacts 134*b* of the inner ground shield 210 is offset from the housing side segment 214. Specifically, in the exemplary embodiment the bottom wall 238 is offset from the housing side segment 214 generally in the direction of the arrow C. The offset aligns the bottom wall 238 of the ground contacts 134*b* of the inner ground shield 210 with the bottom walls 238 of the ground contacts 134*b* of the outer ground shield 212 (FIGS. 4, 7, and 8) when the shields 210 and 212 are mounted on the contact module body 182.

In addition or alternative to the u-shape described and/or illustrated herein, each of the ground contacts 134*b* of the inner ground shield 210 may include any other shape that enable the ground contact 134*b* to mate with the corresponding ground contact 136*b* (FIG. 11) of the receptacle assembly 104 (FIGS. 1, 11, and 12). Examples of additional or alternative shapes for the ground contacts 134*b* include, but are not limited to, a rolled pin shape similar to the signal contacts 134*a*, and/or the like. Although three are shown, the inner ground shield 210 may include any number of the ground contacts 134*b*.

In the exemplary embodiment, the ground contacts 134*b* of the inner ground shield 210 are equally spaced apart from one another. The ground contacts 134*b* of the inner ground shield 210 are optionally shifted towards the circuit edge 220 such that the ground contacts 134*b* are more closely positioned to the bottom of the front edge 216 than the top of the front edge 216.

The inner ground shield 210 includes mounting contacts 244 that extend outwardly from the circuit edge 220 of the housing side segment 214 for engagement with the printed circuit 106 (FIGS. 1 and 12). The engagement between the mounting contacts 244 and the printed circuit 106 electrically connects the mounting contacts 244, and thereby the inner ground shield 210, to the printed circuit 106. The bulk of each mounting contact 244 is optionally positioned inward with respect to the inner ground shield 210, such as in the direction shown by arrow A, which is generally towards the contact module 118 (FIGS. 1-4, 6, 8, and 10) when the shield 210 is mounted on the contact module body 182. In the exemplary embodiment, the mounting contacts 244 are equally spaced apart from one another. The mounting contacts 244 are optionally shifted rearward towards the rear edge 218 such that the mounting contacts 244 are more closely positioned to the rear of the circuit edge 220 than the front of the circuit edge 220.

In the exemplary embodiment, the mounting contacts 244 are eye-of-the needle type contacts that fit into vias (not shown) of the printed circuit 106. But, other types and/or styles of contacts may be provided in alternative embodiments for electrical connection to the printed circuit 106, such as, but not limited to, through hole mounting contacts, surface mounting contacts, and/or the like. Although six are shown, the inner ground shield 210 may include any number of the mounting contacts 244.

Figure 6:
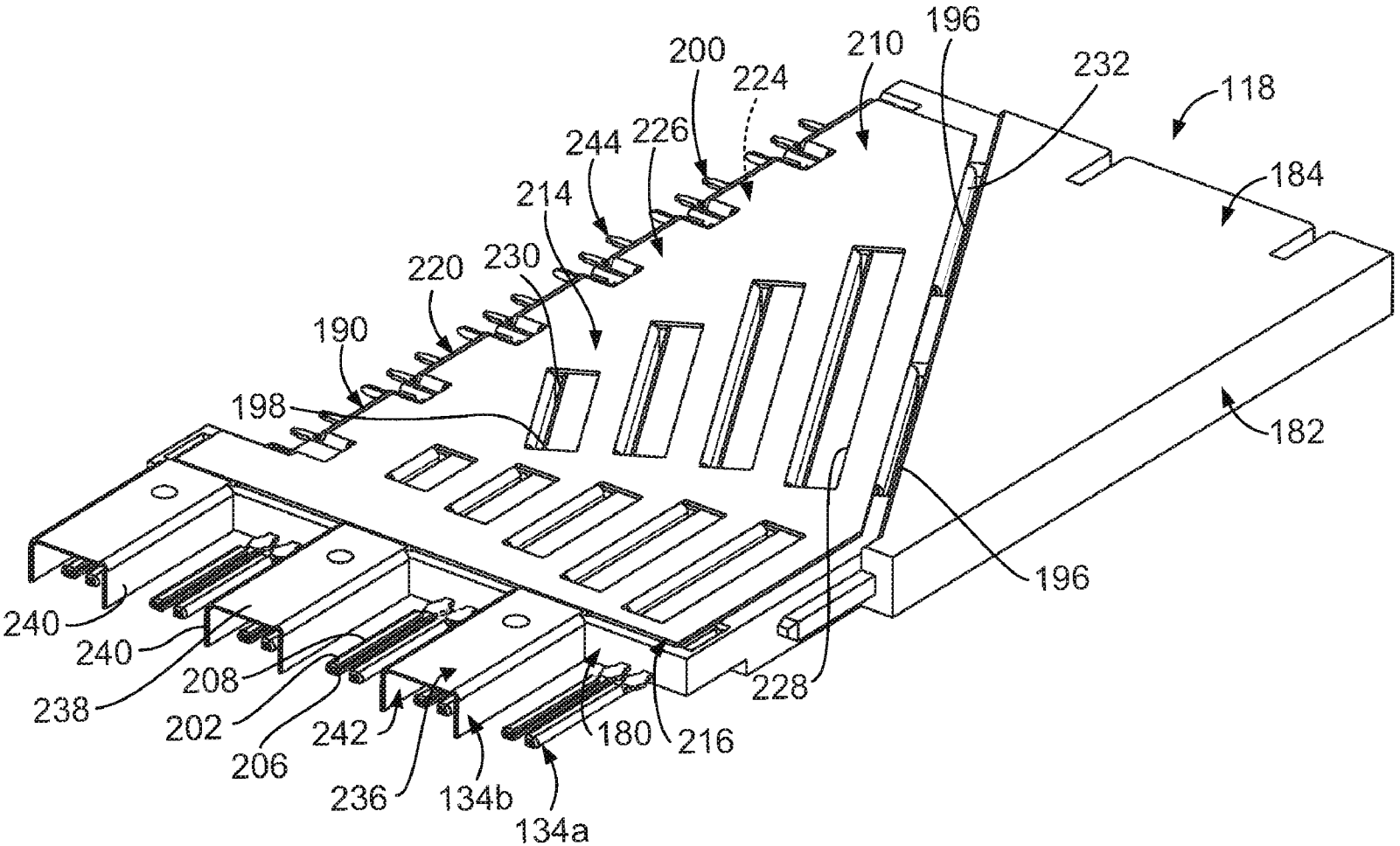
FIG. 6 is a perspective view of the contact module shown in FIGS. 2-4 illustrating the inner ground shield shown in FIGS. 4 and 5 mounted on an exemplary embodiment of a body of the contact module.

FIG. 6 is a perspective view of the contact module 118 illustrating the inner ground shield 210 mounted on the contact module body 182. The inner ground shield 210 is mounted on the side 184 of the contact module body 182 such that the inner side 224 of the shield 210 faces and abuts the contact module body 182 and the outer side 226 faces away from the contact module body 182. The housing side segment 214 extends over at least a portion of the side 184 of the contact module body 182. The front and circuit edges 216 and 220, respectively, are optionally aligned with the mating and mounting edges 180 and 190, respectively, of the contact module body 182. The mounting tabs 232 of the inner ground shield 210 are received within the mounting openings 196 to hold the inner ground shield 210 on the contact module body 182.

Each of the separator extensions 230 of the inner ground shield 210 is received within a corresponding one of the slots 198 of the contact module body 182. Each separator extension 230 extends within the corresponding slot between adjacent electrical leads 188 (FIG. 3). In the exemplary embodiment, each separator extension 230 extends between adjacent differential pairs of the electrical leads 188. As can be seen in FIG. 6, each of the openings 228 exposes a portion of the side 184 of the contact module body 182 when the inner ground shield 210 is mounted on the contact module body 182.

The ground contacts 134*b* extend outwardly from the mating edge 180 of the contact module 118 when the inner ground shield 210 is mounted on the contact module body 182. The body 236 of each ground contact 134*b* extends around at least a portion of at least one of the signal contacts 134*a*. In the exemplary embodiment, differential pairs of the signal contacts 134*a* are received within the cavities 242 of corresponding ground contacts 134*b*. Accordingly, in the exemplary embodiment, the body 236 of each ground contact 134*b* extends around the sides 202, 206, and 208 of the signal contacts 134*a* of the corresponding differential pair. Specifically, the bottom wall 238 of the ground contact 134*b* extends over the sides 202 of the differential pair of signal contacts 134*a*, and the side walls 240 extend over the sides 206 and 208 of the signal contacts 134*a* of the differential pair. The side walls 240 of the ground contacts 134*b* extend between adjacent differential pairs of the signal contacts 134*a*. In some alternative embodiments, one or more of the ground contact bodies 236 extends around only a single signal contact 134*a* that is not arranged in a differential pair.

The mounting contacts 244 of the inner ground shield 210 extend outwardly from the mounting edge 190 of the contact module 118. The pattern of mounting contacts 200 and mounting contacts 244 complement one another such that the mounting contacts 244 of the inner ground shield 210 are positioned between adjacent differential pairs of the mounting contacts 200. In some alternative embodiments, one or more of the mounting contacts 244 of the inner ground shield 210 extends between two adjacent mounting contacts 200 that are not arranged with each other in a differential pair.

Figure 7:
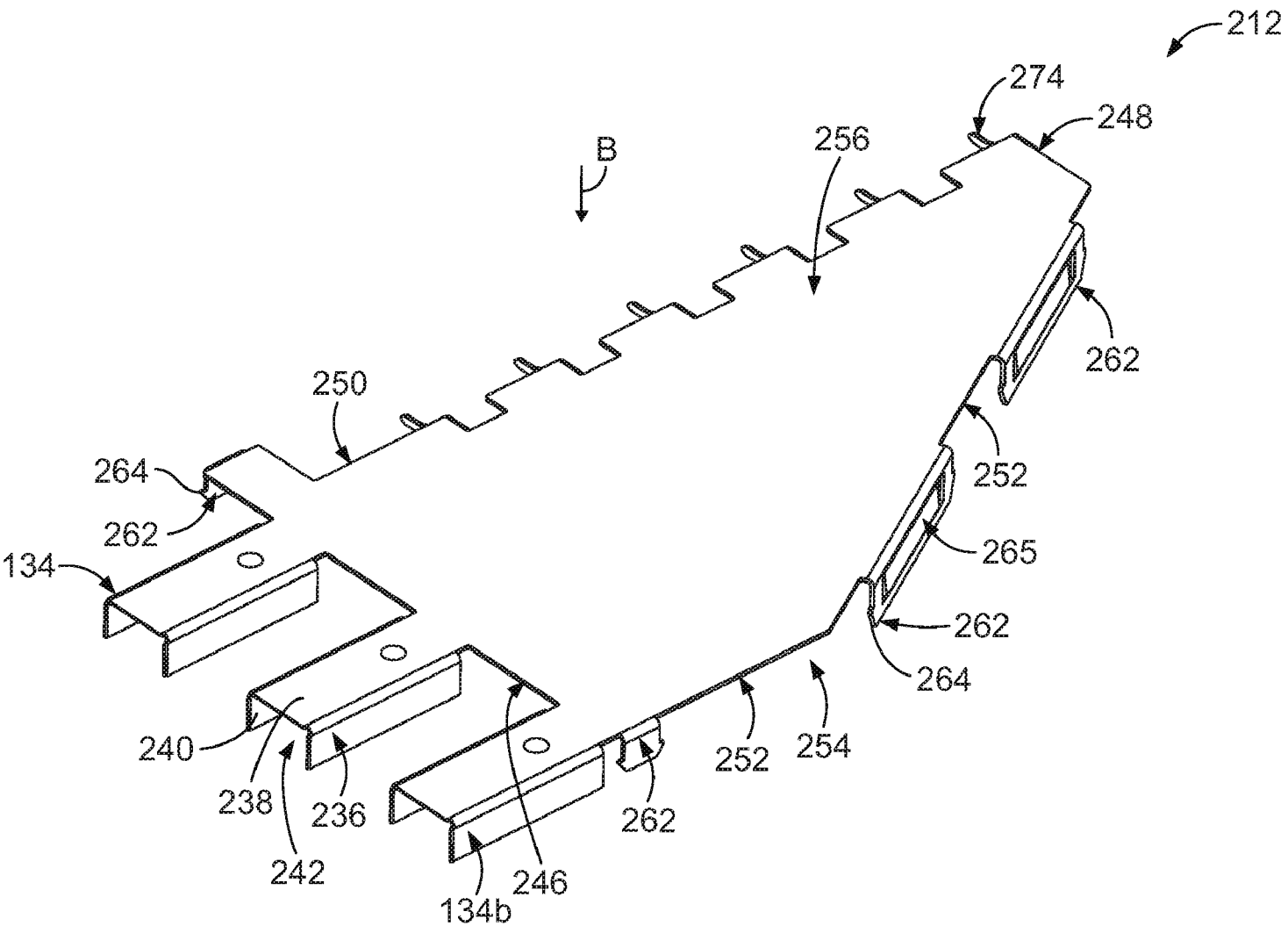
FIG. 7 is a perspective view of an exemplary embodiment of an outer ground shield of the ground shield assembly shown in FIG. 4.

FIG. 7 is a perspective view of an exemplary embodiment of the outer ground shield 212. The outer ground shield 212 extends from a front edge 246 to a rear edge 248 that is opposite the front edge 246. The outer ground shield 212 also extends from a circuit edge 250 to an opposite top edge 252. The circuit and top edges 250 and 252, respectively, extend between, and interconnect, the front edge 246 and the rear edge 248. The outer ground shield 212 includes an inner side 254 and an outer side 256 that is opposite the inner side 254.

A plurality of mounting tabs 262 extend outwardly from the inner side 254 of the outer ground shield 212. The mounting tabs 262 are configured to be received within the mounting openings 196 (FIGS. 2-4, 6, and 8) of the contact module body 182 (FIGS. 2-4, 6, and 8) for mounting the outer ground shield 212 on the contact module body 182. In the exemplary embodiment, the mounting tabs 262 include barbs 264 that are configured to engage the contact module body 182 to connect the outer ground shield 212 to the body 182 using an interference-fit connection. Optionally, one or more of the mounting tabs 262 includes a lance 265 and/or other structure (not shown) that extends outwardly from an interior surface 263 of the tab 262 and engages the corresponding mounting tab 232 (FIGS. 5 and 6) of the inner ground shield 210 (FIGS. 4-6) to electrically connect the shields 210 and 212 together.

In addition or alternative to the mounting tabs 262 and/or the barbs 264, the outer ground shield 212 may be mounted on the contact module body 182 using any other structure, fastener, connection type, and/or the like, such as, but not limited to, a snap-fit, a latch, a clip, a threaded fastener, and/or the like.

The outer ground shield 212 includes some of the ground contacts 134*b* of the mating contacts 134. The ground contacts 134*b* extend outwardly from the front edge 246 of outer ground shield 212. In the exemplary embodiment, the ground contacts 134*b* of the outer ground shield 212 include the u-shaped body 236. Specifically, each ground contact 134*b* of the outer ground shield 212 includes the bottom wall 238 and the pair of opposite side walls 240 that extend outwardly from opposite edges of the bottom wall 238. The walls 238 and 240 define the cavity 242 therebetween. As will be described below, corresponding ones of the signal contacts 134*a* (FIGS. 2-4, 6, 8, and 10) are received within the cavity 242 when the outer ground shield 212 is mounted on the contact module body 182. In addition or alternative to the u-shape described and/or illustrated herein, each of the ground contacts 134*b* of the outer ground shield 212 may include any other shape that enables the ground contact 134*b* to mate with the corresponding ground contact 136*a* (FIG. 11) of the receptacle assembly 104 (FIGS. 1, 11, and 12). Examples of additional or alternative shapes for the ground contacts 134*b* include, but are not limited to, a rolled pin shape similar to the signal contacts 134*a*, and/or the like. Although three are shown, the outer ground shield 212 may include any number of the ground contacts 134*b*.

In the exemplary embodiment, the ground contacts 134*b* of the outer ground shield 212 are equally spaced apart from one another. The ground contacts 134*b* of the outer ground shield 212 are optionally shifted towards the top edge 252 such that the ground contacts 134*b* are more closely positioned to the top of the front edge 246 than the bottom of the front edge 246.

The outer ground shield 212 includes mounting contacts 274 that extend outwardly from the circuit edge 250 for engagement with the printed circuit 106 (FIGS. 1 and 12). The engagement between the mounting contacts 274 and the printed circuit 106 electrically connects the mounting contacts 274, and thereby the outer ground shield 212, to the printed circuit 106. The bulk of each mounting contact 274 is optionally positioned inward with respect to the outer ground shield 212, such as in the direction shown by arrow B, which is generally towards the contact module 118 (FIGS. 1-4, 6, 8, and 10) when the shield 212 is mounted on the contact module body 182. In the exemplary embodiment, the mounting contacts 274 are equally spaced apart from one another. The mounting contacts 274 are optionally shifted rearward towards the rear edge 248 such that the mounting contacts 274 are more closely positioned to the rear of the circuit edge 250 than the front of the circuit edge 250.

In the exemplary embodiment, the mounting contacts 274 are eye-of-the needle type contacts that fit into vias (not shown) of the printed circuit 106. But, other types and/or styles of contacts may be provided in alternative embodiments for electrical connection to the printed circuit 106, such as, but not limited to, through hole mounting contacts, surface mounting contacts, and/or the like. Although six are shown, the outer ground shield 212 may include any number of the mounting contacts 274.

Figure 8:
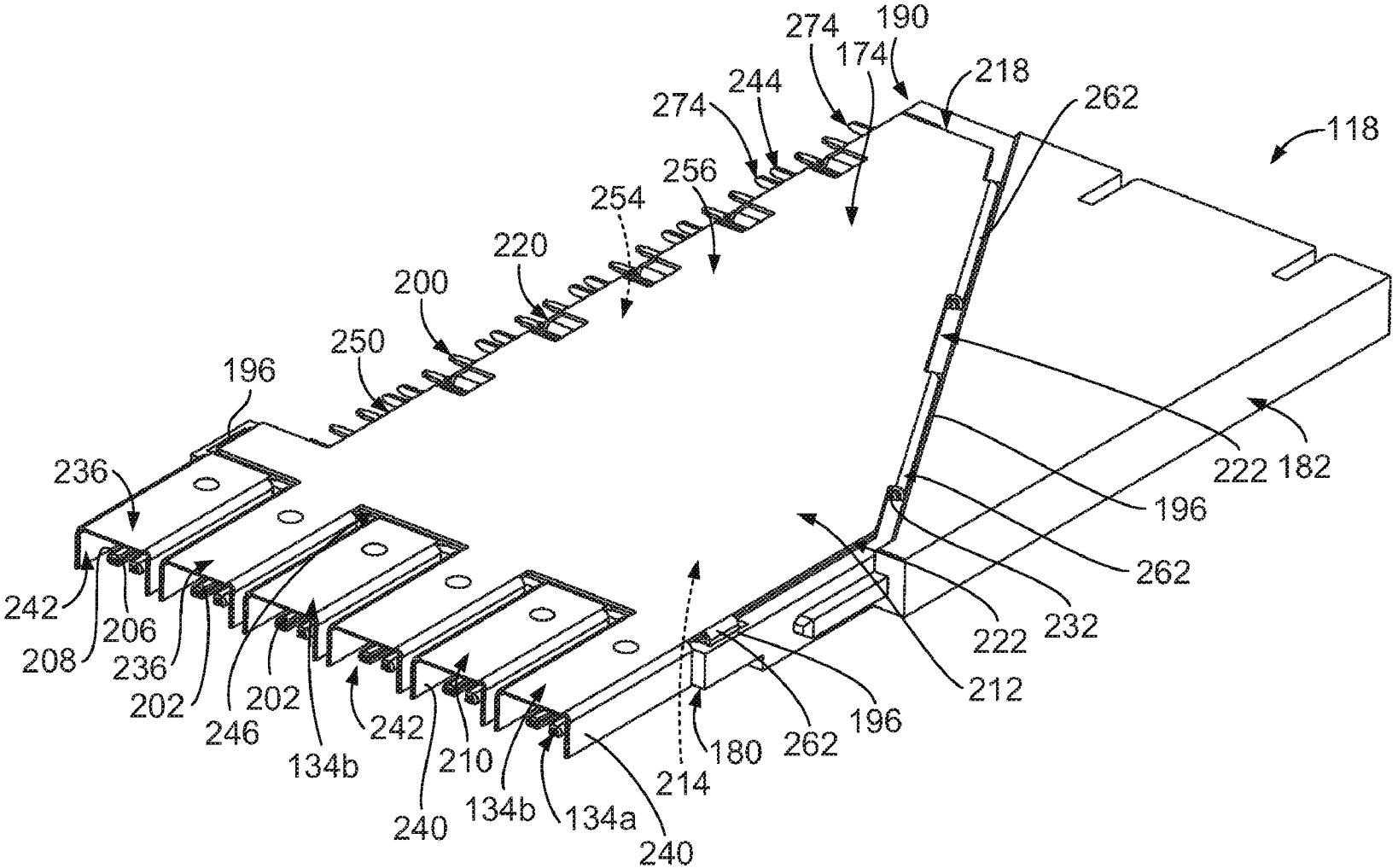
FIG. 8 is an assembled perspective view of the contact module shown in FIGS. 2-4 with the ground shield assembly shown in FIG. 4 mounted thereon.

FIG. 8 is an assembled perspective view of the contact module 118 with the ground shield assembly 174 mounted thereon. The outer ground shield 212 is mounted on the contact module body 182 such that the inner side 254 of the shield 212 faces the contact module 118 and the outer side 256 faces away from the contact module body 182. The front and circuit edges 246 and 250, respectively, are optionally aligned with the mating and mounting edges 180 and 190, respectively, of the contact module body 182. The mounting tabs 262 of the outer ground shield 212 are received within the mounting openings 196 of the contact module body 182 to hold the outer ground shield 212 on the contact module body 182.

The outer ground shield 212 extends over at least a portion of the housing side segment 214 of the inner ground shield 210. In the exemplary embodiment, the outer ground shield 212 extends over the housing side segment 214 of the inner ground shield 210 from the front edge 216 to the rear edge 218 of the inner ground shield 210, and from the circuit edge 220 to the top edge 222 of the inner ground shield 210. But, the outer ground shield 212 may alternatively extend over only a portion of the housing side segment 214. As can be seen in FIGS. 4 and 8, when the outer ground shield 212 extends over the inner ground shield 210, the outer ground shield 212 covers the openings 228 within the inner ground shield 210 such that the outer ground shield 212 covers the portions of the contact module body 182 that are exposed through the openings 228. The inner and outer ground shields 210 and 212, respectively, are engaged with each other, such that the shields 210 and 212 are electrically connected together. For example, in the exemplary embodiment, the outer ground shield 212 is engaged with the housing side segment214 of the inner ground shield 210, and one or more of the mounting tabs 262 of the outer ground shield 212 is engaged with (for example via the optional lance 265) the corresponding mounting tab 232 of the inner ground shield 210.

The ground contacts 134*b* of the outer ground shield 212 extend outwardly from the mating edge 180 of the contact module 118 when the shield 212 is mounted on the contact module body 182. As best seen in FIG. 8, the ground contacts 134*b* of the inner and outer shields 210 and 212, respectively, are interleaved between each other. Specifically, the outer ground shield 212 includes two ground contacts 134*b* that are each interleaved between two corresponding adjacent ground contacts 134*b* of the inner ground shield 210. Similarly, the inner ground shield 210 includes two ground contacts 134*b* that are each interleaved between two corresponding adjacent ground contacts 134*b* of the outer ground shield 212. The body 236 of each ground contact 134*b* of the outer ground shield 212 extends around at least a portion of at least one of the signal contacts 134*a*. In the exemplary embodiment, differential pairs of the signal contacts 134*a* are received within the cavities 242 of corresponding ground contacts 134*b* of the outer ground shield 212. Accordingly, in the exemplary embodiment, the body 236 of each ground contact 134*b* of the outer ground shield 212 extends around the sides 202, 206, and 208 of the signal contacts 134*a* of the corresponding differential pair. The side walls 240 of the ground contacts 134*b* of the outer ground shield 212 extend between adjacent differential pairs of the signal contacts 134*a*. In some alternative embodiments, one or more of the ground contact bodies 236 of the outer ground shield 212 extends around only a single signal contact 134*a* that is not arranged in a differential pair.

The mounting contacts 274 of the outer ground shield 212 extend outwardly from the mounting edge 190 of the contact module 118. The pattern of mounting contacts 200 and mounting contacts 274 complement one another such that the mounting contacts 274 of the outer ground shield 212 are positioned between adjacent differential pairs of the mounting contacts 200. In some alternative embodiments, one or more of the mounting contacts 274 of the outer ground shield 212 extends between two adjacent mounting contacts 200 that are not arranged with each other in a differential pair.

Figure 9:
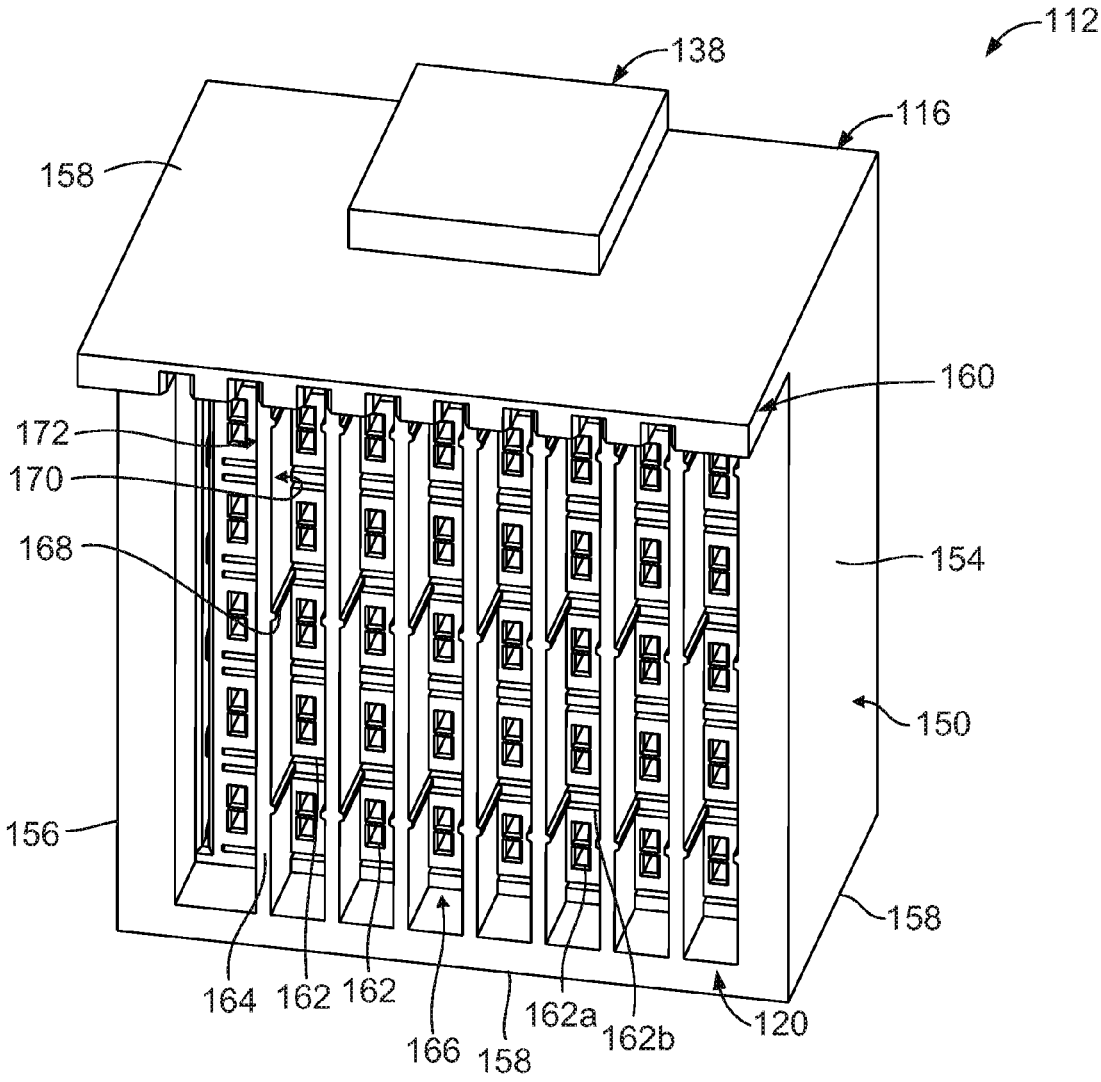
FIG. 9 is a rear perspective view of an exemplary embodiment of a housing of the header assembly shown in FIG. 1.

FIG. 9 is a rear perspective view of an exemplary embodiment of the housing 112 of the header assembly 102 (FIGS. 1, 10, and 12). The housing 112 includes a base 150 extending between the end 116 and an opposite end 120. The base 150 includes a top 154 and a bottom 156. The base 150 includes opposed sides 158 that extend between the top 154 and the bottom 156. A plurality of contact openings 162 extend through the base 150. The contact openings 162 include signal contact openings 162*a* and ground contact openings 162*b*. When the contact modules 118 are held by the housing 112, the mating contacts 134 (FIGS. 1-8 and 10) extend from corresponding contact modules 118 through the contact openings 162 and into the chamber 132 of the housing 112. Specifically, the signal contacts 134*a* extend through the signal contact openings 162*a* and the ground contacts 134*b* extend through the ground contact openings 162*a*. The housing 112 may include any number of the contact openings 162, including any number of the signal contact openings 162*a* and any number of the ground contact openings 162*b*.

Optionally, the alignment features 138 are provided on the sides 158. Alternatively, the alignment features 138 are provided on the top 154 and/or the bottom 156. A shroud 160 extends rearward from the end 120 of the housing 112. The shroud 160 is used to guide and/or hold the contact modules 118.

At the end 120, the base 150 of the housing 112 includes optional walls 164 that define a plurality of optional channels 166. Each channel 166 receives the mating edge 180 (FIGS. 2, 4, 6, 8, and 10) of a corresponding one of the contact modules 118 (FIGS. 1-4, 6, 8, and 10) therein for guiding and/or holding the contact modules 118 to the housing 112. Optional crush ribs 168 extend from the walls 164. Specifically, in the exemplary embodiment, each wall 164 includes a pair of opposite sides 170 and 172 that each include crush ribs 168 extending therefrom. The crush ribs 168 engage the outer ground shield 212 (FIGS. 4, 7, and 8) of each of the contact modules 118 to facilitate holding the contact modules 118 within the channels 166. Moreover, the crush ribs 168 may facilitate forcing the inner and outer ground shields 210 and 212, respectively, into engagement with each other to electrically connect the shields 210 and 212 together. In addition or alternative to the crush ribs 168 on both sides 170 and 172, one or more of the sides 170 and/or 172 may not include any crush ribs 168 extending therefrom. Although two crush ribs 168 are visible on each side 170 and 172 in FIG. 9, each side 170 and 172 may include any number of crush ribs 168 and each wall 164 may include any number of crush ribs 168 overall. Moreover, the housing 112 may include any number of the channels 166 for receiving any number of contact modules 118.

FIG. 10 is a front perspective view of the header assembly 102 illustrating the contact modules 118 held by the housing 112. The contact modules 118 are coupled to the end 120 of the housing 112. Specifically, the mating edge 180 of each of the contact modules 118 is received within a corresponding one of the channels 166. As can be seen in FIG. 10, the mating contacts 134 extend through the contact openings 162 and into the chamber 132 of the housing 112. Specifically, the signal contacts 134*a* extend through the signal contact openings 162*a* and the ground contacts 134*b* extend through the ground contact openings 162*b*.

The ground shield assembly 174 of one of the contact modules 118 is visible in FIG. 10. The ground shield assembly 174 may be grounded to the printed circuit 106 (FIGS. 1 and 12), the contact module 118, and/or the receptacle assembly 104 (FIGS. 1, 11, and 12). In the exemplary embodiment, the ground shield assemblies 174 are identical to one another. Alternatively, one or more of the ground shield assemblies 174 may be different than one or more of the other ground shield assemblies 174, for example to accommodate different types of contact modules 118.

Although eight are shown, the housing 112 may hold any number of the contact modules 118. In the exemplary embodiment, the contact modules 118 are identical to one another. Alternatively, two or more different types of contact modules 118 are held by the housing 112. The different types of contact modules 118 may be used in any order depending on the particular application.

FIG. 11 is a partially exploded perspective view of the receptacle assembly 104. The receptacle assembly includes the housing 122 and the contact modules 128 held by the housing 122. One or more of the contact modules 128 includes a shield or shield assembly 374 mounted thereon. The housing 22 includes the mating face 124, which includes a plurality of contact channels 362 extending therethrough. The contact channels 362 include signal contact channels 362*a* and ground contact channels 362*b*. Each contact module 128 includes the mating contacts 136, which include the signal contacts 136*a* and the ground contacts 136*b*. The signal contacts 136*a* extend outward from mating edges 280 of the contact modules 128 and into the signal contact channels 362*a*. The ground contacts 136*b* extend outward from the mating edges 280 of the contact modules 128 and into the ground contact channels 362*b*. A plurality of mounting contacts 300 extend outwardly from mounting edges 290 of the contact modules 128 for electrically connecting the receptacle assembly 104 to the printed circuit 108 (FIGS. 1 and 2). Although six are shown, the housing 122 may hold any number of the contact modules 128.

FIG. 12 is a perspective view of the orthogonal connector system 100 in a mated position. During mating, at least one of the header assembly 102 and receptacle assembly 104 are moved towards the other along the mating axis 110 until the header assembly 102 and the receptacle assembly 104 are mated together. When mated, an electrical connection is established between the header assembly 102 and the receptacle assembly 104, and a corresponding electrical connection is established between the printed circuits 106 and 108. Optionally, either the receptacle assembly 104 or the header assembly 102 may be in a fixed position and only the other of the receptacle assembly 104 and the header assembly 102 is moved along the mating axis 110 in a mating direction. For example, the header assembly 102 may be fixed within an electronic device such as host device, a computer, a network switch, a computer server and the like, while the receptacle assembly 104 may be part of an external device being electrically connected to the electronic device, or vice versa.

When mated, the housing 122 of the receptacle assembly 104 is received within the housing 112 of the header assembly 102. The signal contacts 134*a* (FIGS. 2-4, 6, 8, and 10) of the header assembly 102 are received within the signal contact channels 362*a* (FIG. 11) of the receptacle assembly 104 and engaged with the signal contacts 136*a* (FIG. 11) of the receptacle assembly 104. Similarly, the ground contacts 134*b* (FIGS. 4-8 and 10) of the header assembly 102 are received within the ground contact channels 362*b* (FIG. 11) of the receptacle assembly 104 and engaged with the ground contacts 136*b* (FIG. 11) of the receptacle assembly 104. An electrical connection between the printed circuits 106 and 108 is thus established by mating the connectors 102 and 104 together. The alignment features 138 and 140 (FIG. 1) cooperate with one another to guide and align the housings 112 and 122 during mating. The alignment features 138 and 140 optionally represent polarization or keying features that are configured to align the housings 112 and 122 in only one mating orientation.

As used herein, the term "printed circuit" is intended to mean any electric circuit in which the conducting connections have been printed or otherwise deposited in predetermined patterns on and/or within an electrically insulating substrate. The substrate may be a flexible substrate or a rigid substrate. The substrate may be fabricated from and/or include any material(s), such as, but not limited to, ceramic, epoxy-glass, polyimide (such as, but not limited to, Kapton® and/or the like), organic material, plastic, polymer, and/or the like. In some embodiments, the substrate is a rigid substrate fabricated from epoxy-glass, which is sometimes referred to as a "circuit board".

The embodiments described and/or illustrated herein may provide a connector system for interconnecting printed circuits, wherein the connector system has an increased electrical performance relative to at least some known connector systems. The embodiments described and/or illustrated herein may provide a ground shield assembly that is capable of having more ground contacts than at least some known ground shields.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A contact module for an electrical connector, said contact module comprising:

a housing having a mating edge, a mounting edge, and a side;

an electrical lead held by the housing, the electrical lead extending from a mating contact to a mounting contact;

an inner ground shield mounted on the housing, the inner ground shield comprising an opening and a housing side segment that extends over at least a portion of the side of the housing between the mating and mounting edges thereof; and an outer ground shield mounted on the housing, the outer ground shield extending over at least a portion of the housing side segment of the inner ground shield such that the outer ground shield covers the opening of the inner ground shield.

2. The contact module according to claim 1, wherein the housing side segment of the inner ground shield comprises opposite front and rear edges and opposite circuit and top edges that extend between the front and rear edges, the outer ground shield extending over the housing side segment of the inner ground shield from the front edge to the rear edge and from the circuit edge to the top edge.

3. The contact module according to claim 1, wherein the housing side segment of the inner ground shield comprises a front edge and a circuit edge, the inner ground shield being mounted on the housing such that the shield front and circuit edges are aligned with the mating and mounting edges, respectively, of the housing, the outer ground shield extending over the housing side segment of the inner ground shield from the front edge to the circuit edge.

4. A contact module for an electrical connector, said contact module comprising:

a housing having a mating edge, a mounting edge, and a side;

an electrical lead held by the housing, the electrical lead extending from a mating contact to a mounting contact, wherein the mating contact of the electrical lead comprises a first contact side and a second contact side that extends from the first contact side;

an inner ground shield mounted on the housing, the inner ground shield comprising a housing side segment that extends over at least a portion of the side of the housing between the mating and mounting edges thereof; and an outer ground shield mounted on the housing, the outer ground shield extending over at least a portion of the housing side segment of the inner ground shield, at least one of the inner ground shield and the outer ground shield comprising a ground contact that extends around the first and second contact sides of the mating contact.

5. The contact module according to claim 4, wherein the ground contact comprises a u-shaped body that extends around the mating contact of the electrical lead.

6. The contact module according to claim 1, wherein the outer ground shield comprises a ground contact that is interleaved between two adjacent ground contacts of the inner ground shield.

7. The contact module according to claim 1, wherein the opening of the inner ground shield exposes a portion of the side of the housing, the outer ground shield covering the exposed portion of the side of the housing.

8. The contact module according to claim 1, wherein the electrical lead comprises two adjacent electrical leads, the housing comprising a slot, the inner shield comprising a separator extension that extends within the slot and between the two adjacent electrical leads.

9. The contact module according to claim 1, wherein the mating contact comprises a differential pair of mating contacts, at least one of the inner ground shield and the outer ground shield comprising a ground contact, the ground contact comprising a u-shaped body that extends around the differential pair of mating contacts.

10. The contact module according to claim 1, wherein the inner and outer ground shields each comprise a front edge aligned with the mating edge of the housing, each of the inner and outer ground shields comprising a ground contact extending from the front edge thereof.

11. An electrical connector for mating with a mating connector, the electrical connector comprising:

a housing; and a contact module held by the housing, the contact module comprising:

a dielectric body having a mating edge, a mounting edge, and a side;

an electrical lead held by the body, the electrical lead extending from a mating contact to a mounting contact;

an inner ground shield mounted on the body, the inner ground shield comprising a body side segment that extends over at least a portion of the side of the body between the mating and mounting edges thereof, the inner ground shield comprising a first ground contact that is configured to mate with a corresponding ground contact of the mating connector; and an outer ground shield mounted on the body, the outer ground shield extending over at least a portion of the body side segment of the inner ground shield, the outer ground shield comprising a second ground contact that is configured to mate with a corresponding ground contact of the mating connector.

12. The electrical connector according to claim 11, wherein the body side segment of the inner ground shield comprises opposite front and rear edges and opposite circuit and top edges that extend between the front and rear edges, the outer ground shield extending over the body side segment of the inner ground shield from the front edge to the rear edge and from the circuit edge to the top edge.

13. The electrical connector according to claim 11, wherein the mating contact of the electrical lead comprises a first contact side and a second contact side that extends from the first contact side, and wherein one of the first ground contact or the second ground contact extends around the first and second contact sides of the mating contact.

14. The electrical connector according to claim 11, wherein the body side segment of the inner ground shield comprises a front edge and a circuit edge, the inner ground shield being mounted on the body such that the shield front and circuit edges are aligned with the mating and mounting edges, respectively, of the body, the outer ground shield extending over the body side segment of the inner ground shield from the front edge to the circuit edge.

15. The electrical connector according to claim 11, wherein one of the first ground contact or the second ground contact comprises a u-shaped segment that extends around the mating contact of the electrical lead.

16. The electrical connector according to claim 11, wherein the inner ground shield comprises a third ground contact that is adjacent the first ground contact of the inner ground shield, the second ground contact of the outer ground shield being interleaved between the adjacent first and third ground contacts of the inner ground shield.

17. The electrical connector according to claim 11, wherein the inner ground shield comprises an opening that exposes a portion of the side of the body, the outer ground shield covering the opening of the inner ground shield such that the outer ground shield covers the exposed portion of the side of the body.

18. The electrical connector according to claim 11, wherein the electrical lead comprises two adjacent electrical leads, the body comprising a slot, the inner shield comprising a separator extension that extends within the slot and between the two adjacent electrical leads.

19. The electrical connector according to claim 11, wherein the mating contact comprises a differential pair of mating contacts, one of the first ground contact or the second ground contact comprising a u-shaped segment that extends around the differential pair of mating contacts.

20. The electrical connector contact module according to claim 11, wherein the inner and outer ground shields each comprise a front edge aligned with the mating edge of the body, the first and second ground contacts extending from the front edge of the inner and outer ground shields, respectively.

* * * * *